US005355810A

United States Patent [19]

Camilleri

[11] Patent Number: 5,355,810

[45] Date of Patent: Oct. 18, 1994

[54] SHELF AND SUPPORT ARM ASSEMBLY

[75] Inventor: Charles Camilleri, St. Louis, Mo.

[73] Assignee: Lee/Rowan Company, St. Louis, Mo.

[21] Appl. No.: 796,639

[22] Filed: Nov. 22, 1991

[51] Int. Cl.[5] ..... A47B 23/04

[52] U.S. Cl. ..... 108/42; 248/235; 211/90

[58] Field of Search ..... 108/42, 47, 48; 248/235; 211/90

[56] References Cited

U.S. PATENT DOCUMENTS

| | | | |
|---|---|---|---|
| 4,316,593 | 2/1982 | Miner et al. | 211/90 |
| 4,374,498 | 2/1983 | Yellin | 108/42 |
| 4,662,595 | 5/1987 | Camilleri | 108/42 |
| 4,735,325 | 4/1988 | Remmers | 211/90 |
| 4,893,772 | 1/1990 | Scott | 211/90 |

FOREIGN PATENT DOCUMENTS

| | | | |
|---|---|---|---|
| 0079456 | 5/1983 | European Pat. Off. | 211/181 |
| 3506542 | 9/1986 | Fed. Rep. of Germany | 211/181 |
| 2601570 | 7/1986 | France | 248/235 |

*Primary Examiner*—Kenneth J. Dorner
*Assistant Examiner*—Janet M. Long
*Attorney, Agent, or Firm*—Rogers, Howell & Haferkamp

[57] ABSTRACT

A shelf and support arm assembly is comprised of a wire shelf having two different embodiments, the support surface of the shelf being formed by a plurality of parallel, spatially arranged longitudinal wires where a given lateral spacing between the wires differentiates one embodiment of the shelf from another. A support arm is suspended from a forward end of the shelf to facilitate the assembly of the shelf and support arm to a vertical support surface. The support arm is specifically configured so that the same support arm may be employed in attaching both embodiments of the shelf to the vertical support surface.

12 Claims, 1 Drawing Sheet

SHELF AND SUPPORT ARM ASSEMBLY

BACKGROUND OF THE INVENTION (1) Field of the Invention

The present invention relates to a wire shelf and support arm assembly. In particular, the present invention relates to a wire shelf having a support surface formed by a plurality of spatially arranged longitudinal wires, and a support arm designed to be suspended beneath the shelf member to facilitate the attachment of the shelf and support arm to a vertical surface, and designed to be attached to different embodiments of the shelf member having different spatial arrangements of their pluralities of longitudinal wires.

(2) Description of the Related Art

Various different types of wire shelf assemblies are known in the prior art. These prior art assemblies typically include a shelf member constructed of pluralities of crisscrossing wires. The typical shelf member is comprised of a first plurality of parallel, longitudinally extending wires each having opposite front and back ends and each being substantially the same length. The first plurality of wires are arranged side by side, with a set lateral spacing between adjacent wires. At least one back wire extends laterally beneath the back ends of the longitudinal wires and is secured to each of the plurality of wires. At least one front wire extends laterally beneath the front ends of the plurality of longitudinal wires and is also secured to each of the front ends of the plurality of wires. The connection between the laterally extending front and back wires and the plurality of longitudinally extending wires secures the longitudinally extending wires in their laterally spaced relationship.

In many different prior art wire shelf members, the lateral spacings between the adjacent longitudinally extending wires of the shelf members is different. Typically however, the plurality of longitudinally extending wires are spaced laterally from each other by one inch or one-half inch spacings.

The shelf support arms of prior art shelf assemblies are usually formed as elongate rods having one end configured to be attached to a vertical support surface, and an opposite end configured to be attached to a forward portion of the shelf member. In assembling a prior art shelf and support arm assembly to a vertical support surface, the rearward edge or back wire of the shelf member is usually first secured to the vertical support surface. The shelf member is then held horizontal while the support arm is connected between a forward portion of the shelf member and the vertical support surface. In the assembled relative positions of the shelf member and support arm, the shelf member is secured to the vertical support surface along its rearward edge or back wire and projects horizontally outward from the vertical support surface. The support arm is positioned at an angle relative to the underside of the shelf member, with a rearward end of the support arm being secured to the vertical support surface and a forward end of the support arm being secured in some manner to a forward portion of the shelf member.

Many prior art wire shelf and support arm assemblies are disadvantaged in that the component parts of the assemblies are not interchangeable with other assemblies. In many prior art shelf and support arm assemblies the lateral spacing between the plurality of longitudinal wires forming the support surface of the shelf requires that the specific support arm designed for use with the shelf be used in assembling the shelf and support arm to a vertical support surface. In many applications, the forward end of the support arm engages between a pair of the plurality of longitudinally extending wires and therefore is specifically dimensioned to be used with a shelf having a specific lateral spacing between the plurality of longitudinally extending wires. In these types of prior art-shelf assemblies, a support arm having a forward end dimensioned to engage between adjacent longitudinal wires of one shelf may not work with a shelf having a plurality of longitudinal wires spaced at a different lateral spacing. For a manufacturer who produces wire shelves of various sizes and with various lateral spacings between the longitudinal wires of the different shelves, the necessity of producing a specific support arm for each of the different shelves drives up the costs of producing the different shelf and support arm assemblies.

Many prior art wire shelf and support arm assemblies are also disadvantaged in that they are relatively difficult to assemble to a vertical support surface. Assembly of the shelf to the support surface requires that the rearward edge or the back wire of the wire shelf first be secured to the support surface. The shelf is then held in a horizontal orientation while the support arm is secured beneath the shelf between a forward portion of the shelf and the vertical support surface. This usually requires one person to hold the shelf in its horizontal orientation while a second person positions the support arm beneath the shelf, engaging a forward end of the support arm with a forward portion of the underside of the shelf and attaching the rearward end of the support arm to the vertical support surface.

What is needed to overcome the above set forth disadvantages of prior art wire shelf and support arm assemblies is a wire shelf and support arm assembly where the forward end of the support arm is specifically configured to be used with a variety of different wire shelves having different lateral spacings between the pluralities of longitudinal wires of the shelves. What is also needed is a support arm having a forward end that can be releasably attached to the forward portion of the wire shelf and suspended from the shelf as the rearward end of the support arm is pivoted back toward the vertical support surface and attached to the support surface, thereby facilitating the attachment of the shelf and support arm assembly to the support surface.

SUMMARY OF THE INVENTION

The present invention provides a shelf and support arm assembly comprising a wire shelf and a support arm, where the support arm is specifically configured to facilitate the attachment of the assembly to a vertical support surface, and to enable the arm to be used with different wire shelf members.

The shelf member of the assembly is constructed of pluralities of crisscrossing wires. The shelf member includes a first plurality of parallel, spatially arranged longitudinal wires. Each of the plurality of longitudinal wires has opposite front and back ends, and each has substantially the same longitudinal length. The plurality of longitudinal wires are arranged with a set lateral spacing between adjacent wires. The lateral spacing is a first given distance for one embodiment of the shelf member and a second given distance, one half the first distance, for a second embodiment of the shelf member.

At least one support arm is employed in the assembly to secure and support the shelf member to a vertical support surface. The support arm is an elongate member having opposite forward and rearward ends, with the rearward end being configured to be attached to the vertical support surface. The forward end of the support arm is formed with a pair of projecting hook members spaced laterally from each other. Support shoulder surfaces are formed on the forward end of the support arm on opposite sides of the pair of hook members, and one support shoulder surface is formed between and separates the pair of hook members. Together, the pair of hook members have a overall width dimension that enables the pair of hook members to be inserted between adjacent longitudinal wires of the first embodiment of the shelf member where adjacent longitudinal wires are separated by the first given distance. Each of the individual hook members has a width dimension chosen to enable the individual hook members to be inserted between adjacent longitudinal wires of the shelf member in the second embodiment of the shelf member where the wires are separated by the second given distance, one half the first given distance.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENTS

Figures 1, 2, 3, 4, 5, 6, 7:
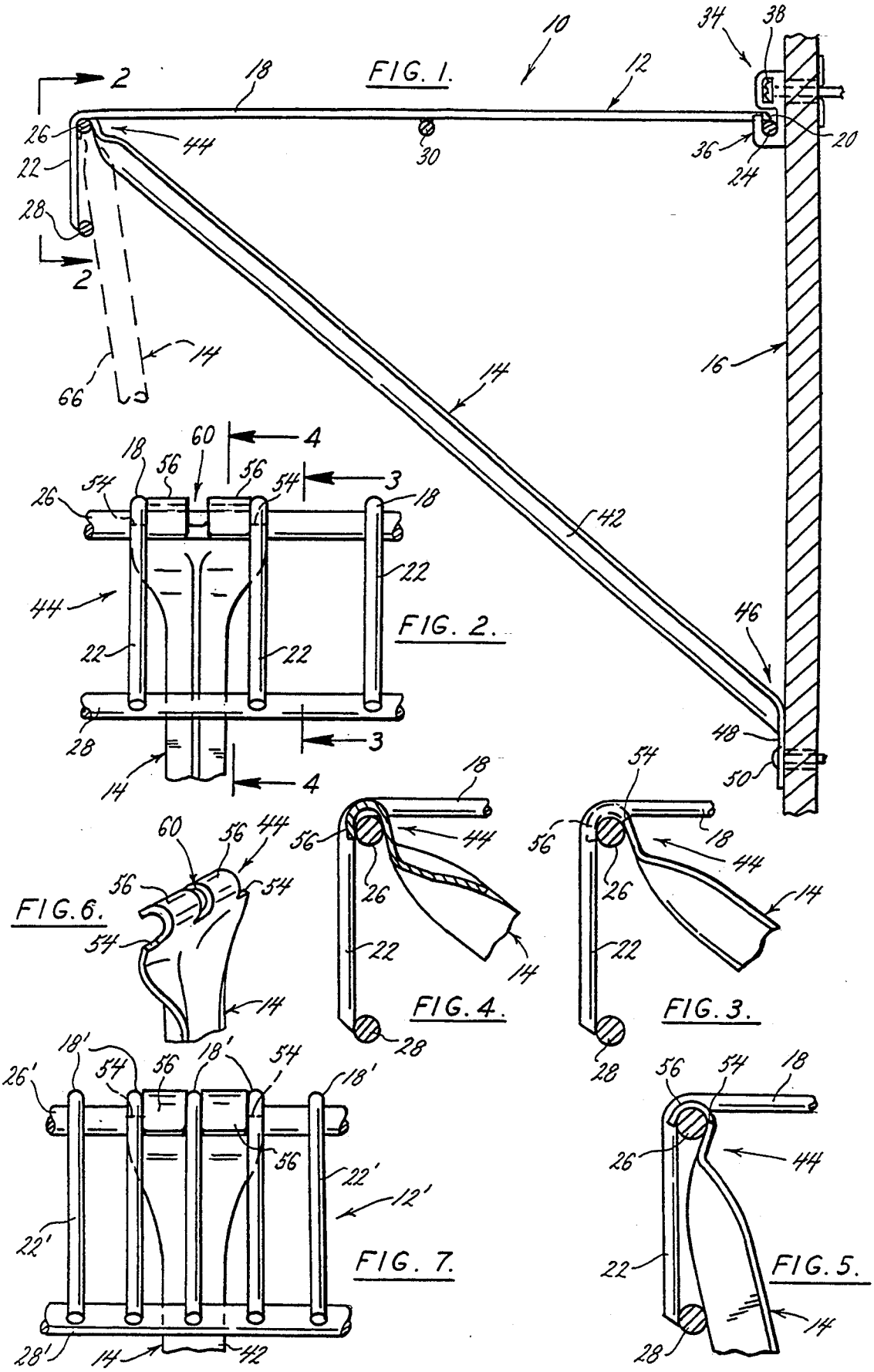
FIG. 1 is a side elevation view of the shelf and support arm assembly of the present invention.
FIG. 2 is a partial front elevation view of a first embodiment of the shelf and support arm assembly taken along the line 2—2 of FIG. 1.
FIG. 3 is a partial side elevation view of the shelf and support arm assembly taken along the line 3—3 of FIG. 2.
FIG. 4 is a partial side elevation view, in section, of the shelf and support arm assembly taken along the line 4—4 of FIG. 2.
FIG. 5 is a partial side elevation view of the shelf and support arm assembly.
FIG. 6 is a partial perspective view showing the forward end of the support arm of the shelf and support arm assembly.
FIG. 7 is a partial front elevation view of a second embodiment of the shelf and support arm assembly.

The shelf and support arm assembly 10 of the present invention is shown in FIG. 1. The assembly is basically comprised of a wire shelf 12 and a support arm 14 employed in supporting the shelf in a horizontal orientation from a vertical support surface 16. In the preferred embodiments of the invention, the shelf 12 and support arm 14 are both constructed of metal but may be constructed of other materials.

The shelf 12 is generally comprised of pluralities of crisscrossing wires. A top support surface of the shelf is formed by a plurality of parallel, spatially arranged longitudinal wires 18. Each of the longitudinal wires 18 has a rearward end 20 and a forward end 22. As seen in FIG. 1, the forward ends 22 of the longitudinal wires 18 are bent at downward right angles relative to the support surface formed by the plurality of longitudinal wires 18.

A plurality of lateral wires extend across the undersides of the plurality of longitudinal wires and secure the longitudinal wires in their spatial arrangement. A back lateral wire 24 extends across the width of the shelf 12 and is secured to the rearward ends 20 of each of the longitudinal wires 18. A front lateral wire 26 extends across the undersides of the forward ends 22 of each of the longitudinal wires 18. The front wire 26 is also secured to each of the longitudinal wires and secures the longitudinal wires in their spatial arrangement. A lower front lateral wire 28 and an intermediate lateral wire 30 also extend across and are secured to the undersides of each of the longitudinal wires 18. The intersections between each of the plurality of longitudinal wires 18 and the lateral wires 24, 26, 28, 30 are secured together by welds or other equivalent methods. The connections between the lateral wires 24, 26, 28, 30 and the plurality of longitudinal wires 18 secures the longitudinal wires 18 in their spatial arrangement with adjacent longitudinal wires 18 being separated by a given distance. In the first embodiment of the invention, the longitudinal wires 18 that form the support surface of the shelf 12 are laterally separated by a given first distance.

In the second embodiment of the invention only the lateral spacing between adjacent longitudinal wires is different from that of the first embodiment of the invention. The second embodiment of the shelf member is shown in FIG. 7 and the component parts of the shelf member have the same reference numbers as the component parts of the first embodiment of the shelf member only followed by primes. In the second embodiment of the invention, the longitudinal wires 18' that form the support surface of the shelf 12' are laterally separated by a second given distance, one half the first given distance. In the preferred embodiment of the invention, the first given distance is one inch between centerlines of adjacent longitudinal wires 18 and the second given distance is one half inch between centerlines of adjacent longitudinal wires 18'.

The rearward edge of the shelf 12 is secured to the vertical support surface 16 by mounting hardware 34 of the assembly. In FIG. 1, the mounting hardware 34 is shown as a J-shaped hook 36 that engages beneath the lateral back wire 24 of the shelf 12 and is secured to the vertical support surface 16 by a threaded fastener 38. Several of the hooks 36 are spaced along the lateral width of the shelf 12 and secure the lateral back wire 24 of the shelf to the vertical support surface in a horizontal orientation of the wire relative to the surface. In assembling the shelf assembly of the present invention to the vertical support surface 16, the back wire 24 of the shelf 12 is first secured in the horizontal orientation to the vertical surface 16 by the mounting hardware 34. As can be seen in FIG. 1, the J-shaped configuration of the mounting hardware 34 enables the shelf 12 to be pivoted about the axis of the lateral back wire 24.

The support arm 14 is formed with an elongate, straight middle section 42 with opposite forward 44 and rearward 46 ends. The rearward end 46 is formed as a flat flange 48 that is bent at a slight angle relative to the middle section 42 of the support arm. A hole (not shown) is provided through the center of the flange 48. A threaded fastener 50 is inserted through the hole (not shown) of the flange 48 and into the vertical support surface 16 to secure the rearward end 46 of the support arm 14 to the support surface. In assembling the shelf assembly of the invention to the vertical support surface 16, the rearward end 46 of the support arm is not secured to the support surface until the forward end 44 is properly connected to the forward edge of the shelf 12 as will be described.

The forward end 44 of the support arm 14 expands laterally outward from the middle section 42 of the support arm and is provided with support shoulder surfaces 54 at its opposite lateral sides. Formed between the opposite support shoulder surfaces 54 are a pair of projecting hook members 56. Between and separating the pair of projecting hook members 56 is a third support shoulder surface 58 provided at the bottom of a slot 60 separating the hook members 56. The curvature of the pair of hooks 56 is chosen so that the inner surfaces of the hooks will engage in sliding engagement over the exterior surface of the lateral front wire 26 of the shelf 12. Engagement of the pair of hooks 56 over the lateral front wire 26 provides a pivoting connection between the support arm 14 and the shelf 12. With the shelf held in a substantially horizontal orientation projecting from the vertical support surface, the pivoting connection enables the support arm to pivot relative to the shelf from a first position where the support arm 14 is suspended from the front wire 26 by the hooks 56 in a general perpendicular orientation relative to the support surface of the shelf 12 (shown in phantom lines 66 in FIG. 1), to a second position where the support arm 14 is suspended from the front wire 26 at an acute angle orientation relative to the support surface of the shelf 12 as shown in FIG. 1.

The lateral widths of the pair of hook members 56 are chosen to enable the support arm 14 to be used with the two different embodiments of the shelf 12 having different lateral spacings between adjacent longitudinal wires 18 of the shelf. As shown in FIG. 2, the lateral widths of the pair of hook members 56 are determined so that the total overall width of the pair of hook members 56 enables both hook members to be engaged over the front wire 26 of the shelf positioned between adjacent longitudinal wires 18 of the first embodiment of the shelf. The lateral widths of the individual hook members 56 enable the hook members to be engaged over the front wire 26' positioned between adjacent longitudinal wires 18' of the second embodiment of the shelf as shown in FIG. 7. This configuration of the support arm forward end 44 enables the support arm 14 of the invention to be employed in supporting two different embodiments of shelves. In the first embodiment of FIG. 2, the longitudinal wires 18 of the shelf are laterally spaced a given distance apart. In the second embodiment of the shelf shown in FIG. 7, the longitudinal wires 18' of the shelf are laterally spaced a second given distance apart, one-half of the first given distance.

In attaching the forward end 44 of the support arm 14 to the front wire 26 of the shelf, and assembling the rearward end 46 of the support arm 14 to the vertical support surface 16, the support shoulder surfaces 54, 58 at the forward end 44 of the support arm 14 are moved into supporting engagement beneath adjacent longitudinal wires 18 of the shelf 12. In the first embodiment of the shelf shown in FIG. 2, as the hook members 56 are engaged and suspended over the front wire 26 and the support arm 14 is pivoted relative to the front wire 26 by moving the rearward end 46 of the support arm longitudinally back toward the vertical support surface 16, the opposite support shoulder surfaces 54 at the forward end of the support arm will rotate over the exterior surface of the front wire 26 until they engage between the underside of adjacent longitudinal wires 18 and the front wire 26 as shown in FIG. 3. The positioning of the shoulder surfaces 54 beneath the longitudinal wires 18 is maintained by the projection of the hook members 56 between the wires 18. The wedging engagement of the opposite pair of shoulder surfaces 54 between the front wire 26 and the undersides of the adjacent longitudinal wires 18 provides a secure supportive connection between the forward end 44 of the support arm and the forward end of the shelf 12 that prevents the forward end of the shelf from being separated from the forward end 44 of the support arm when the shelf and support arm assembly 10 are assembled to the vertical support surface 16.

When employed in supporting the shelf of the second embodiment of the invention shown in FIG. 7, all three support shoulder surfaces 54, 58 wedge between the front wire 26' and the undersides of three adjacent longitudinal wires 18' as the rearward end 46 of the support arm is pivoted back toward the vertical support surface 16. As seen in FIG. 7, three adjacent longitudinal wires 18' pass on opposite sides of the pair of hook members 56 and through the slot 60 between the hook members. As the support arm 14 is pivoted on the front; wire 26', the opposite pair of support shoulder surfaces 54 and the center support shoulder surface 58 will rotate over the front wire until they engage between the front wire 26' and the undersides of the three adjacent longitudinal wires 18' in much the same manner as the first embodiment of the invention. The positioning of the shoulder surfaces 54, 58 beneath the longitudinal wires 18' is maintained by the projections of the hook members 56 between the three adjacent wires 18'.

The pivoting connection provided by the pair of hook members 56 engaging over the front wire 26 of the shelf 12 facilitates the assembly of the shelf and support arm assembly of the present invention to the vertical support surface 16. With the back lateral wire 24 secured to the vertical support surface 16 by the mounting hardware 34 as described earlier, the shelf 12 is pivoted upward relative to the vertical support surface 16 until it is positioned in its horizontal orientation shown in FIG. 1. With the installer of the shelf assembly holding the shelf in its horizontal orientation, the support arm 14 is suspended from the shelf 12 by engaging the pair of hooks 56 over the front wire 26 of the shelf. When the first embodiment of the invention is employed with the first given lateral spacing between 2-adjacent longitudinal wires 18 of the shelf, both hook members 56 engage over the front wire 26 between adjacent longitudinal wires 18. This enables two support shoulder surfaces 54 to engage against and support the undersides of the adjacent longitudinal wires 18 as will be explained. If the pair of hooks 56 are engaged over the front wire 26 straddling one of the longitudinal wires 18 of the shelf embodiment shown in FIG. 2, only the center support shoulder surface 58 will engage against the underside of the longitudinal wire 18 and support the wire.

With the support arm 14 suspended by the pair of hooks 56 from the front wire 26 in the general perpendicular orientation of the support arm 14 relative to the shelf support surface shown in phantom lines 66 in FIG. 1, the shelf 12 is pivoted about the back wire 24 to ensure it is positioned in a substantially horizontal orientation. With the shelf 12 held in the horizontal orientation by one hand of the installer, the support arm 14 is pushed longitudinally backward by the second hand of the installer so that the rearward end flange 48 of the support arm engages against the vertical support surface 16. With the flange 48 engaged against the support surface 16, the installer removes his one hand from the shelf and inserts the threaded fastener 50 through the hole (not shown) in the flange and into the support surface 16 to complete the assembly of the shelf and support arm assembly to the support surface. As explained earlier, as the support arm 14 is pivoted back toward the support surface 16, the support shoulder surfaces 54 rotate around the front wire 26 and wedge in engagement between the support wire 26 and the undersides of the two adjacent longitudinal wires 18.

In assembling the shelf and support arm assembly of the present invention employing the second embodiment of the shelf to the vertical support surface, the procedures are the same. With the back wire secured to the vertical support surface 16 by the mounting hardware, the shelf 12' is pivoted until it is positioned in a horizontal orientation relative to the support surface. Next, the forward end 44 of the support arm 14 is suspended over the front wire 26' by engaging the pair of hooks 56 over the front wire. The engagement of the pair of hooks 56 over the front wire 26' of the second embodiment of the shelf is shown in FIG. 7. The pair of hooks 56 engage over the front wire 26' on opposite sides of one of the longitudinal wires 18' and between the pair of next adjacent longitudinal wires 18'. With the support arm suspended from the front wire 26', the orientation of the shelf 12' is adjusted to a substantially horizontal orientation. Next, the support arm 14 is pivoted backward about the front wire 26' until the flange 48 at the rearward end of the support arm engages against the vertical support surface 16. With the flange 48 engaged against the support surface 16, the threaded fastener 50 is inserted through the hole (not shown) in the flange 48 and into the support surface 16 to complete the assembly of the second embodiment of the invention to the support surface. In a similar manner to the first embodiment of the invention, as the support arm 14 is pivoted back toward the vertical support surface 16, the three support shoulder surfaces 54, 58 rotate over the front wire 26' and wedge in engagement between the front wire 26' and the undersides of the three adjacent longitudinal wires 18'.

In the manner described above, the shelf and support arm assembly of the present invention 10 provides a wire shelf that is easily assembled to a vertical support surface, and a support arm that may be used with two different embodiments of the shelf having two different lateral spacings between adjacent longitudinal wires of the shelf. The specific configuration of the support arm enables it to be suspended from a forward edge of the shelf to facilitate its assembly to the vertical support surface.

While the present invention has been described by reference to specific embodiments, it should be understood that modifications and variations of the invention may be constructed without departing from the scope of the invention defined in the following claims.

What is claimed is:

1. A shelf assembly comprising:

a shelf member formed of a plurality of crisscrossing wires, the plurality of wires including at least one back wire extending laterally across a back edge of the shelf member and at least one front wire extending laterally across a front edge of the shelf member, the front and back wires being longitudinally spaced from each other;

means for securing the back wire to a vertical wall surface;

at least one support arm, the support arm having opposite first and second ends, the first end of the support arm being provided with means for securing the first end to a vertical wall surface, and the second end of the support arm being provided with at least one hook thereon, the hook being releasably engagable over the front wire of the shelf member for releasably attaching the second end of the support arm to the front wire of the shelf member for pivoting movement relative thereto, the hook having a configuration for suspending the support arm from the front wire of the shelf member solely by the hook with the front wire and the back wire positioned in a horizontal plane and the support arm positioned generally perpendicular to the horizontal plane;

the plurality of crisscrossing wires of the shelf member form a substantially planar support surface of the shelf member, and the hook enables the support arm to be suspended beneath and pivoted relative to the support surface from a first position where the support arm is suspended by the front wire at a substantially perpendicular orientation relative to the support surface, to a second position where the support arm is suspended by the front wire at an acute angle orientation relative to the support surface; and, the plurality of crisscrossing wires of the shelf member include a plurality of parallel, spatially arranged longitudinal wires each having opposite front and back ends, with the back wire extending laterally across and being secured to the back ends of each of the longitudinal wires and the front wire extending laterally across and being secured to the front ends of each of the longitudinal wires, and the second end of the support arm is formed with at least a pair of shoulder surfaces thereon, the shoulder surfaces being provided on opposite sides of the hook and being configured to engage against and support a pair of longitudinal wires of the plurality of longitudinal wires with the hook projecting between the pair of longitudinal wires.

2. A shelf assembly comprising:

a shelf member having a support surface formed of a plurality of crisscrossing wires, the plurality of wires including a plurality of parallel, spatially arranged longitudinal wires each having opposite front and back ends and each being laterally separated, a back wire extending laterally across and being secured to the back ends of each of the longitudinal wires, and a front wire extending laterally across and being secured to the front ends of each of the longitudinal wires;

means for securing the back wire to a vertical wall surface; and at least one support arm, the support arm having opposite first and second ends, the first end of the support arm being provided with means for securing the first end to a vertical wall surface, and the second end of the support arm being provided with means for engaging beneath and supporting the front ends of an adjacent pair of longitudinal wires of the plurality of longitudinal wires by a second distance smaller than the first distance.

3. The assembly of claim 2, wherein:

the second end of the support arm is provided with means for positioning the engaging and supporting means beneath the adjacent longitudinal wires.

4. The assembly of claim 3, wherein:

the positioning means includes at least one projecting member on the second end of the support arm, the engaging and supporting means being positioned on opposite sides of the projecting member, and the projecting member being inserted between the adjacent longitudinal wires thereby positioning the engaging and supporting means beneath the adjacent longitudinal wires.

5. The assembly of claim 3, wherein:

the positioning means includes a pair of separate projecting members on the second end of the support arm, the engaging and supporting means being positioned on opposite sides of the pair of projecting members and in between the pair of projecting members, the pair of projecting members being inserted between the adjacent longitudinal wires where the adjacent longitudinal wires are separated by the first distance, and each projecting member of the pair of projecting members being inserted between the adjacent longitudinal wires where the adjacent longitudinal wires are separated by the second distance.

6. The assembly of claim 2, wherein:

the engaging and supporting means includes a plurality of separate shoulder surfaces formed on the second end of the support arm, the separate shoulder surfaces engaging beneath and supporting the front ends of the adjacent longitudinal wires both where the adjacent longitudinal wires are separated by the first distance, and where the adjacent longitudinal wires are separated by the second distance.

7. The assembly of claim 6, wherein:

at least one projecting member is formed on the second end of the support arm between and separating a pair of the plurality of shoulder surfaces, the projecting member being inserted between the adjacent longitudinal wires and positioning the pair of shoulder surfaces beneath the adjacent longitudinal wires both where the adjacent longitudinal wires are separated by the first distance, and where the adjacent longitudinal wires are separated by the second distance.

8. The assembly of claim 7, wherein:

the projecting member is configured in the shape of a hook, the hook having a configuration that is releasably engagable over the front wire of the shelf member for suspending the support arm from the front wire and for pivoting the support arm relative to the support surface from a first position where the support arm is suspended by the front wire at a substantially perpendicular orientation of the support arm relative to the support surface, to a second position where the support arm is suspended by the front wire at an acute angle orientation of the support arm relative to the support surface.

9. The assembly of claim 6, wherein:

a pair of separate projecting members are formed on the second end of the support arm, a shoulder surface of the plurality of shoulder surfaces is positioned on opposite sides of the pair of projecting members and a shoulder surface of the plurality of shoulder surfaces is positioned between and separates the pair of projecting members, the pair of projecting members being inserted between the adjacent longitudinal wires where the adjacent longitudinal wires are separated by the first distance, and each projecting member of the pair of projecting members being inserted between the adjacent longitudinal wires where the adjacent longitudinal wires are separated by the second distance.

10. The assembly of claim 9 wherein:

the pair of projecting members are configured in the shapes of hooks, the hooks having a configuration that is releasably engagable over the front wire of the shelf member for suspending the support arm from the front and for pivoting the support arm relative to the support surface from a first position where the support arm is suspended by the front wire at a substantially perpendicular orientation of the support arm relative to the support surface, to a second position where the support arm is suspended by the front wire at an acute angle orientation of the support arm relative to the support surface.

11. A shelf assembly comprising:

a shelf member having a support surface formed of a plurality of crisscrossing wires, the plurality of wires including a plurality of parallel, spatially arranged longitudinal wires each having opposite front and back ends and each being laterally separated, a back wire extending laterally across and being secured to the back ends of each of the longitudinal wires, and a front wire extending laterally across and being secured to the front ends of each of the longitudinal wires;

means for securing the back wire to a vertical wall surface; and at least one support arm, the support arm having opposite first and second ends, the first end of the support arm being provided with means for securing the first end to a vertical wall surface, and the second end of the support arm being provided with means for releasably attaching the second end to the front wire of the shelf member for pivoting movement relative thereto, the attaching means suspending the support arm from the front wire of the shelf member with the support surface of the shelf member being positioned horizontally and the support arm positioned generally perpendicular to the support surface, and the second end of the support arm being provided with means for engaging beneath and supporting the front ends of an adjacent pair of longitudinal wires of the plurality of wires by a second distance, smaller than the first distance.

12. The assembly of claim 11, wherein:

the first distance is twice as large as the second distance.

* * * * *